US007918287B2

(12) United States Patent
Foley

(10) Patent No.: US 7,918,287 B2
(45) Date of Patent: Apr. 5, 2011

(54) SUCTION CORING DEVICE AND METHOD

(76) Inventor: Alan Foley, Houston, TX (US)

( * ) Notice: Subject to any disclaimer, the term of this patent is extended or adjusted under 35 U.S.C. 154(b) by 599 days.

(21) Appl. No.: 12/018,373

(22) Filed: Jan. 23, 2008

(65) Prior Publication Data

US 2008/0179091 A1 Jul. 31, 2008

Related U.S. Application Data

(60) Provisional application No. 60/881,927, filed on Jan. 23, 2007.

(51) Int. Cl.
*E21B 7/26* (2006.01)
*E21B 7/04* (2006.01)

(52) U.S. Cl. ..... 175/20; 175/58; 37/320

(58) Field of Classification Search ..... 175/6, 20, 175/58; 37/307.317, 320.346; 405/224, 405/228

See application file for complete search history.

(56) References Cited

U.S. PATENT DOCUMENTS 1,870,696 A * 8/1932 Taylor ..... 175/17
1,907,155 A * 5/1933 Murdock ..... 175/246
2,076,063 A * 4/1937 Burt ..... 175/324
2,313,576 A * 3/1943 Phillips et al. ..... 175/44
2,769,614 A * 11/1956 Zeni ..... 175/94
2,855,050 A * 10/1958 Smith ..... 175/235
3,412,814 A * 11/1968 Rosfelder ..... 175/6
3,434,551 A * 3/1969 Rosfelder ..... 175/6
3,701,387 A 10/1972 Koot ..... 175/6
3,741,320 A * 6/1973 Hilfing ..... 175/6
4,217,709 A * 8/1980 Casciano ..... 37/308
4,234,046 A 11/1980 Haynes ..... 175/6
4,432,671 A * 2/1984 Westra et al. ..... 405/226
4,575,282 A * 3/1986 Pardue et al. ..... 405/228
5,704,732 A * 1/1998 Horton, III ..... 405/228
6,390,206 B1 5/2002 Aardal ..... 175/6
6,394,192 B1 5/2002 Frazer ..... 175/58
6,457,908 B1 * 10/2002 Bergeron ..... 405/224
6,517,287 B2 * 2/2003 Zaiger ..... 405/128.25
6,719,496 B1 4/2004 Von Eberstein ..... 405/224
6,817,309 B2 11/2004 Horton ..... 114/264
6,907,931 B2 * 6/2005 Bessonart ..... 166/336
7,621,059 B2 * 11/2009 McCoy et al. ..... 37/317
7,681,662 B2 * 3/2010 Asakawa et al. ..... 175/20

FOREIGN PATENT DOCUMENTS

SU 608920 * 5/1978

OTHER PUBLICATIONS

"Products in Action: Sampling Soft Clay Layers in Depth," *Offshore Engineer*, p. 73 (Nov. 2006).
"AZ05 ROV Suction Anchor Pump" Data Sheet, Advanced Marine Innovation Technology Subsea Ltd. (2004)(3 pages).

* cited by examiner

*Primary Examiner* — Thomas A Beach
(74) *Attorney, Agent, or Firm* — Shawn Hunter

(57) ABSTRACT

Devices and methods for obtaining cores from a sea bed. A corer device includes one or more core barrels for retaining a cores and one or more pressure barrels. Fluid pressure within the pressure barrels is selectively varied to cause the corer device to be drawn into and released from the sea bed. The core barrels are provided with core catchers for retaining a core within.

19 Claims, 14 Drawing Sheets

SUCTION CORING DEVICE AND METHOD

This application claims the benefit of U.S. Provisional Patent Application Ser. No. 60/881,927 filed Jan. 23, 2007.

BACKGROUND OF THE INVENTION

1. Field of the Invention

The invention relates generally to devices and methods for obtaining cores from a sea bed.

2. Description of the Related Art

Current practices for seabed coring employ a coring device that is deployed from a surface vessel in a single coring run. The coring device relies on gravity to accelerate the coring device toward the sea floor and to provide the force with which the coring device penetrates the sea floor sediment. Alternatively, a drilling rig is deployed, either on a surface vessel or mounted on a remotely operated vehicle (ROV) which is landed on the sea bed. The drilling rig cores the sediment by rotary coring or by pushing a core barrel into the sea floor using the mass of the drill rig or drill string as a reaction mass against which to push the coring barrel. The core barrels are then recovered by wireline of with the ROV.

Among the disadvantages of existing systems and current practice is the limited penetration of gravity assisted drop corers, limited size (diameter and length) of cores due to restricted retrieval winch capacity and lack of attitude control for a drop corer. The drill rig method of taking cores is more precise and allows for greater penetration. However, these devices require dynamically positioned (DP) surface vessels for support. DP vessels are expensive and in limited supply. In addition, the drilling rigs themselves are costly to operate and maintain.

The present invention is directed to overcoming the problems of the prior art.

SUMMARY OF THE INVENTION

The present invention provides improved devices and methods for obtaining cores from a sea bed and retrieving them to the water surface. The suction corer of the present invention provides an inexpensive, portable system to obtain sediment cores from the sea bed. In addition, the suction corer of the present invention is simple to operate and handle and provides a means for retrieving large volumes of sediment from the sea floor. The suction corer can be operated from one of the smaller surface vessels that are in general use in offshore operations and are available at moderate cost. In preferred configurations, the suction corer is similar in dimensions to a survey AUV (autonomous underwater vehicle), such as the Hugin 3000 AUV, a generally about 1 meter in diameter and around 6 meters in length. The small size and weight will allow the suction corer to be launched and operated from an AUV support ship with little modification.

In one aspect of the invention, a method is described for deploying one or more core barrels in a substantially simultaneous manner on the sea floor and driving the core barrels into the sea floor sediments to fill the core barrels with sediment. Thereafter, the core barrels and sediment within are withdrawn and retrieved to the surface vessel. Suction is used to drive the core barrels into the sea floor, and air pressure is used to withdraw the corer from the sea bed and provide buoyancy to float the corer.

In a preferred embodiment, the suction corer devices and methods of the present invention include a coring locator system which allows the suction corer to be redeployed multiple times to the same general location or core hole. Thus, the suction corer can re-enter the same core hole and core to additional depth within. This method allows cores to be taken at depths that are multiples of the length of the suction corer body.

In another preferred embodiment of the invention, an extended suction coring device is constructed using a plurality of individual suction corer bodies that are concatenated together. This is preferably done at the surface vessel as the corer device is deployed into the water. This technique provides a single coring device having a currently preferred extended length that is 3-5 times that of a single coring device section. The extended suction coring device is useful in situations wherein it is desired to sample in extremely soft sediments in a single coring run and avoid the problem of hole collapse and the need to case the core hole with multiple strings of casing.

In a further embodiment, one or more of the pressure cells are provided with a fluid jet apparatus which allows injection of water toward the sea bed. The jet(s) can be selectively actuated prior to or during the coring operation to help displace sediment and is allow the corer device to reach a greater depth.

BRIEF DESCRIPTION OF THE DRAWINGS

For detailed understanding of the invention, reference is made to the following detailed description of the preferred embodiments, taken in conjunction with the accompanying drawings in which reference characters designate like or similar elements throughout the several figures of the drawings.

DETAILED DESCRIPTION OF THE PREFERRED EMBODIMENTS

Figure 1:
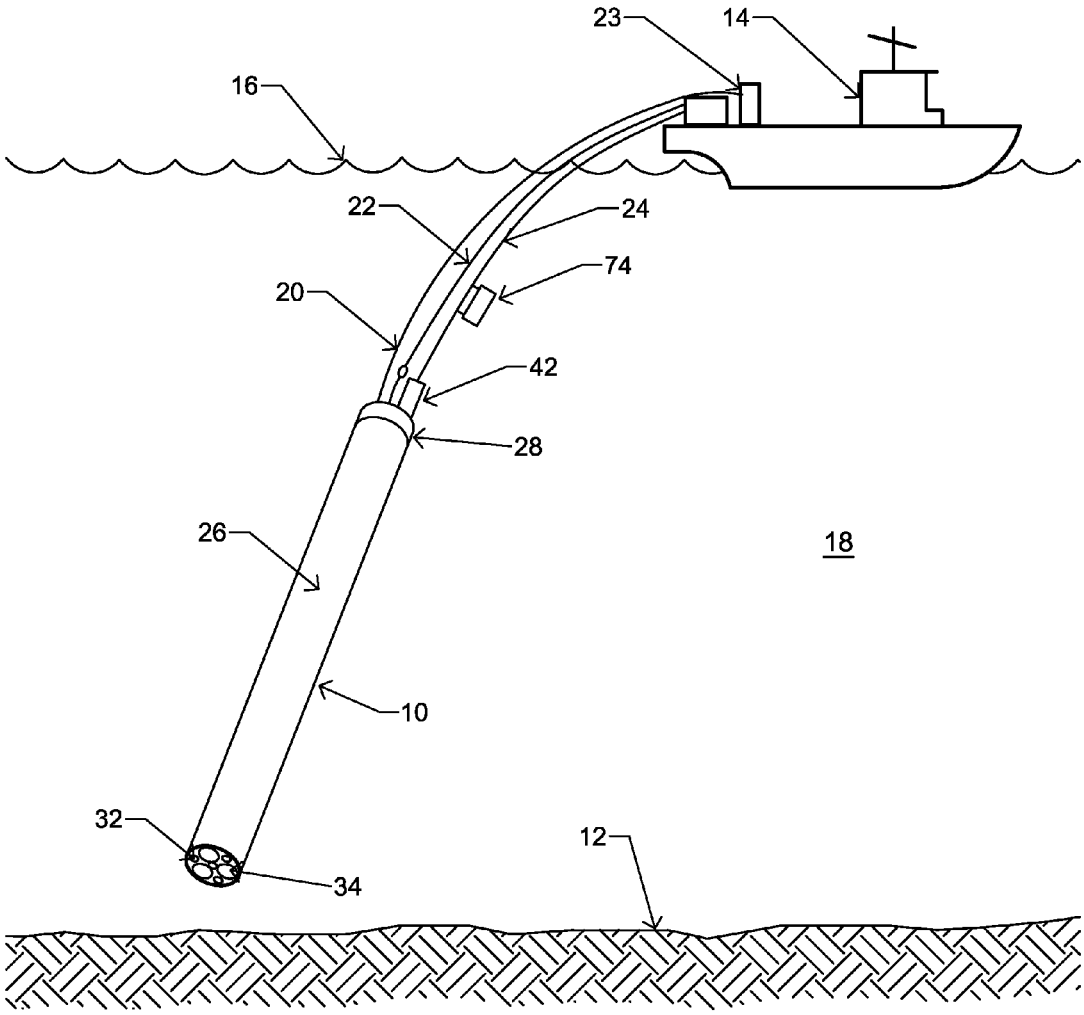
FIG. 1 is an illustration of an exemplary suction corer constructed in accordance with the present invention shown during deployment toward a sea bed.

FIG. 1 depicts an exemplary suction corer device 10 in accordance with the present invention, which is useful for obtaining cores from a seabed 12. FIG. 1 depicts the corer device 10 having been deployed from a vessel 14 floating on the surface 16 of the sea 18. The corer device 10 is deployed from the vessel 14 by a mechanical tether 20. In addition, an air supply conduit 22 and a control line 24 extend from the vessel 14 to the corer device 10.

Figure 2:
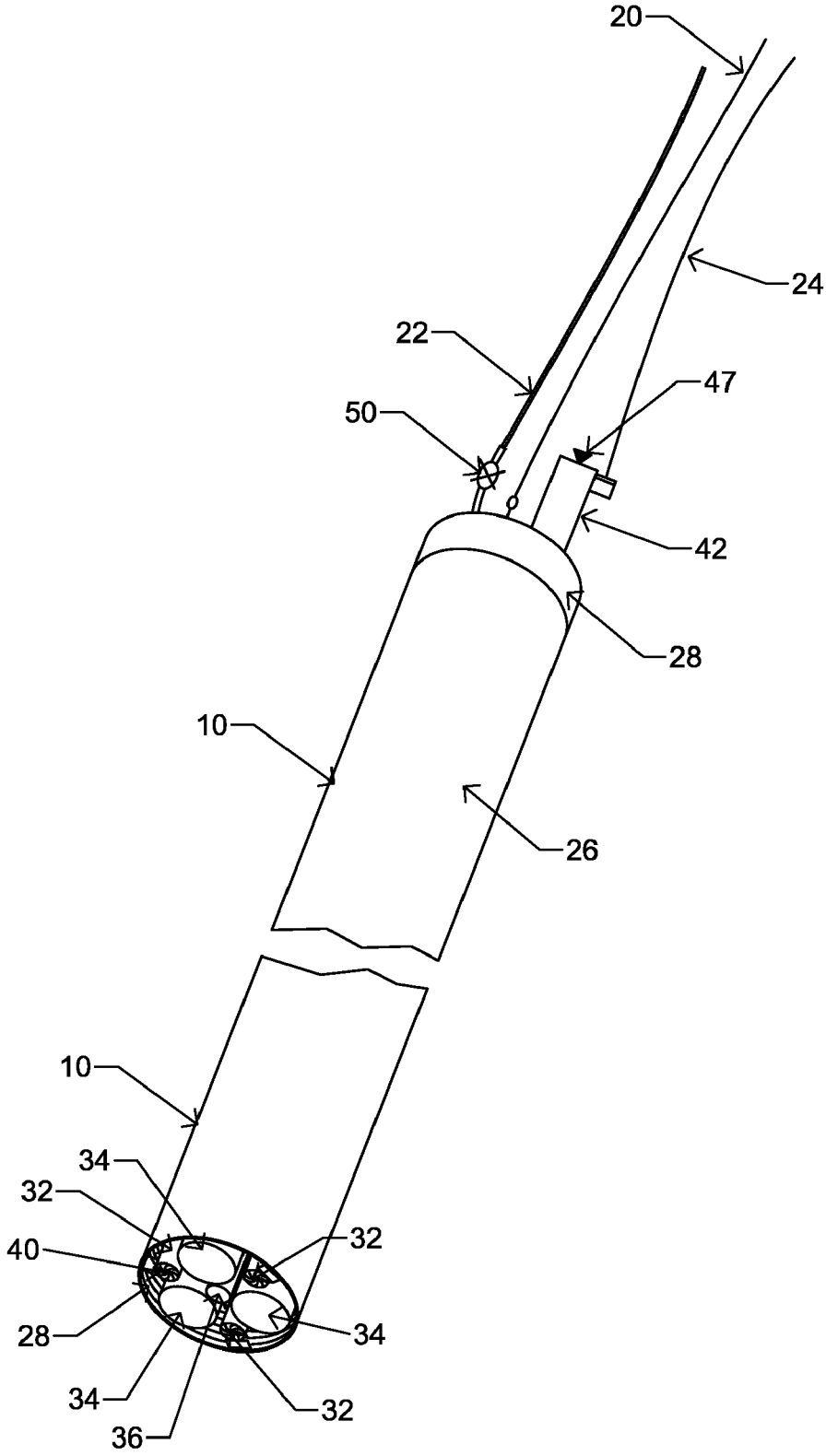
FIG. 2 is an isometric side view of the exemplary suction corer shown in FIG. 1 shown in greater detail.
Figure 3:
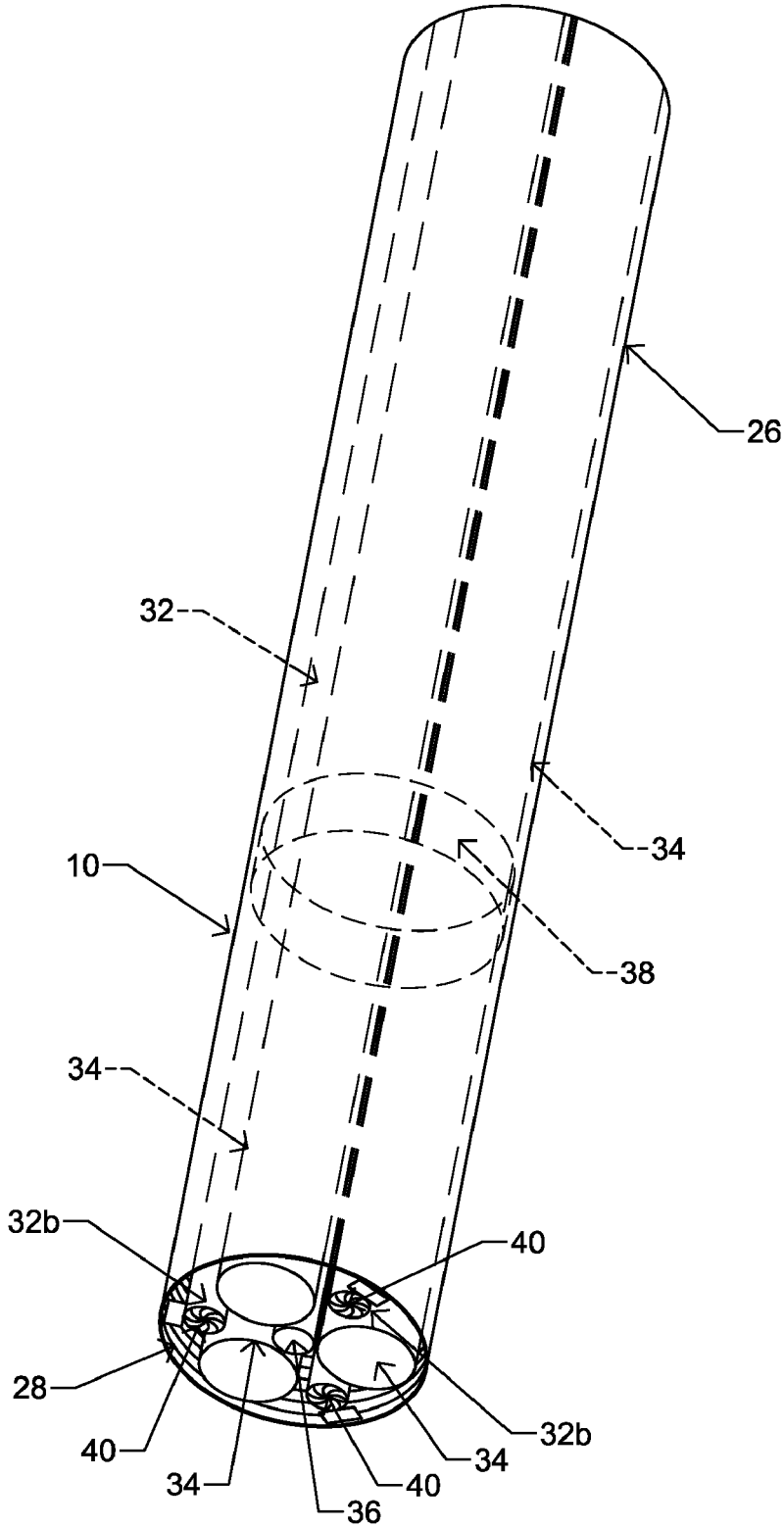
FIG. 3 is an isometric side view of the suction corer body, depicting internal details of construction.

Construction of the exemplary corer device 10 is better understood with additional reference to FIGS. 2 and 3. The exemplary corer device 10 has an elongated, generally cylindrical outer casing 26 which defines a central axial chamber 28. A pressure housing 30 is secured to the upper end of the casing 26 by threading, welding, or another means known in the art. The central chamber 28 contains a set of hollow, generally cylindrical core barrels 32 and a set of hollow, generally cylindrical pressure barrels 34. In the depicted embodiment, there are three core barrels 32 and three pressure barrels 34. However, there may be more or fewer of each, as desired. Preferably, the core barrels 32 and the pressure barrels 34 are formed of a durable metal such as aluminum of hardened steel. The core barrels 32 and pressure barrels 34 are substantially parallel with each other. The core barrels 32 separate from the pressure barrels 34, and there is no fluid communication between them. Each of the core barrels 32 has a proximal end 32*a* (see FIG. 5) and a distal end 32*b* (see FIG. 3). The distal end 32*b* is open while the proximal end 32*a* is substantially closed. The distal end 32*a* may have a small opening (not shown) to allow for the release of air or water trapped within, but otherwise is closed.

In a preferred embodiment, a structural rod 36 is secured to the pressure housing 30 and extends through the central chamber 28. As depicted in FIG. 3, the core barrels 32 and the pressure barrels 34 are preferably secured to the central rod 36 by straps 38 (one shown) which surround the core barrels 32 and pressure barrels, thereby increasing the axial strength of the corer device 10. As best seen in FIG. 3, the distal end 32*b* of each of the core barrels 32 includes a core catcher 40, of a type known in the art, to assist in retaining a core within the core barrel 32. It is noted that, in preferred embodiments, the interior axial cross-sectional area of the pressure barrels 34 is greater than the interior axial cross-sectional area of the core barrels 32. In further preferred embodiments, the pressure barrels 34 have a diameter that is approximately ten times the diameter of the core barrels 32. This permits increased force to be applied for burial of the core barrels 32, withdrawal of the core barrels 32 and floatation of the corer device 10 to the water surface.

In currently preferred embodiments, the corer device 10 is portable in size. In a currently preferred embodiment, the corer device 10 is similar in dimensions to a survey AUV (autonomous underwater vehicle), such as the Hugin 3000 AUV, a generally about 1 meter in diameter and around 6 meters in length. The small size and weight will allow the suction corer to be launched and operated from an AUV support ship with little modification.

Figure 4:
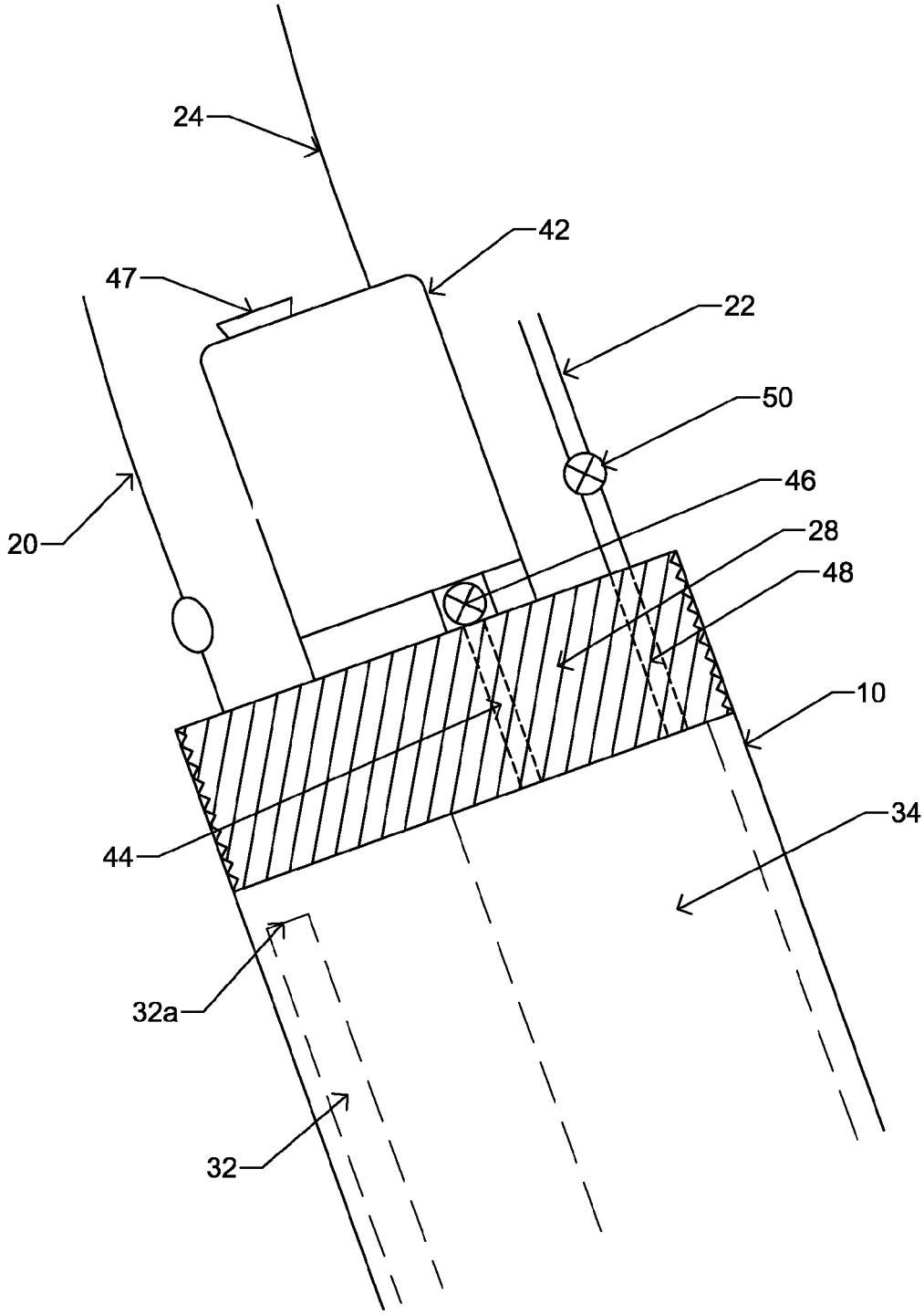
FIG. 4 is a side view of upper portions of the exemplary suction corer device.

FIG. 4 depicts aspects of the upper portion of the exemplary corer device 10 in greater detail. As best seen there, a suction pump 42 is affixed to or integrated into the pressure housing 28. A suitable suction pump for this application is the AZ20 Suction Anchor Pump available commercially from Advanced Marine Innovation Technology Limited of Gosport, England. An air outlet 44 extends from the pump 42 through the pressure housing 28 and into the pressure barrels 34. Although FIG. 4 only depicts the air outlet 44 as connected with a single pressure barrel 34, this is merely for clarity. In actuality, the air outlet 44 is interconnected with each of the three pressure barrels 34 (or whatever number of pressure barrels 34 is contained within the corer device 10). The air outlet 44 is provided with a valve 46, which is operable to selectively open and close air flow through the air outlet 44. When activated, the suction pump 42 will evacuate air from within the pressure barrels 34 through the air outlet and release the removed air into the surrounding sea 18 via air exhaust 47. The suction pump 42 and valve 46 are preferably actuated from the surface vessel 14 via the control line 24, in a manner known in the art. However, if desired, the pump 42 and valve 46 may be actuated manually by a diver or ROV (remotely operated vehicle), or by wireless electronic means or other means known in the art.

As also shown by FIG. 4, the air supply conduit 22 is secured to a fluid inlet 48 in the pressure housing 28. The fluid inlet 48 is in fluid communication with each of the pressure barrels 34. Again, although the inlet 48 is only shown in communication with a single pressure barrel 34, in actuality, the inlet 48 is in communication with each of the pressure barrels 34 within the corer device 10. A valve 50 is incorporated into the air supply conduit 22 and is operable to selectively open and close fluid flow through the conduit 22. In operation, the air supply conduit 22 is constantly pressurized from the surface vessel 14 with air from an air source, such as an air compressor 23 of a type known in the art and maintained and operated aboard the vessel 14. The valve 50 is operated to selectively flow fluid through the inlet 50 and into the sediment chambers 34. The valve 50 may be actuated by a control line (not shown), or manually by divers or an ROV, wirelessly or in any other manner known in the art. Also, it is noted that other gases and fluids in addition to "air" may be used for selectively filling the sediment chambers 34. For example, compressed oxygen, helium, nitrogen or other suitable gases or fluids may be used.

Figure 5A:
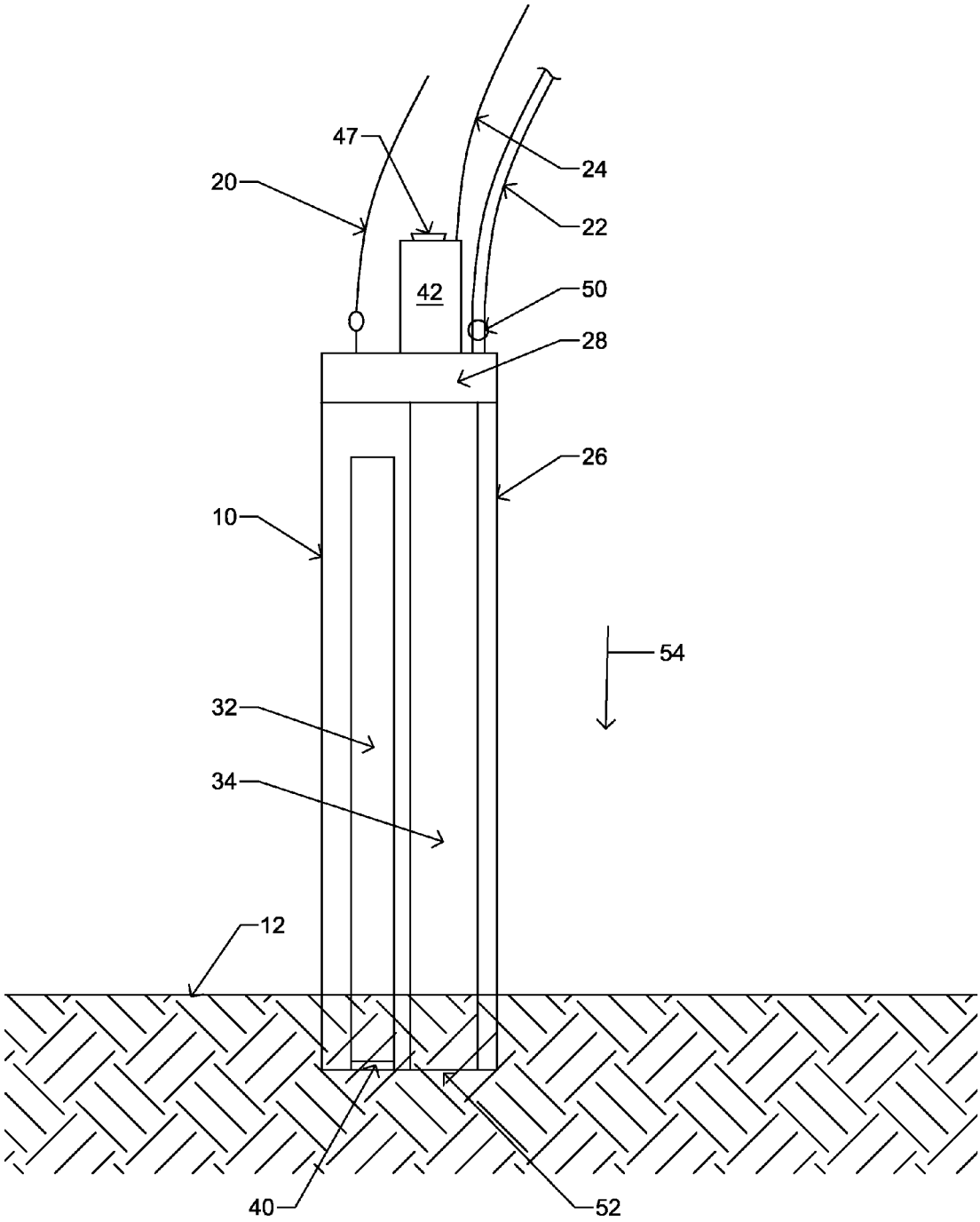
FIG. 5A is a side view of the suction corer device now having been landed on the sea bed.
Figure 5B:
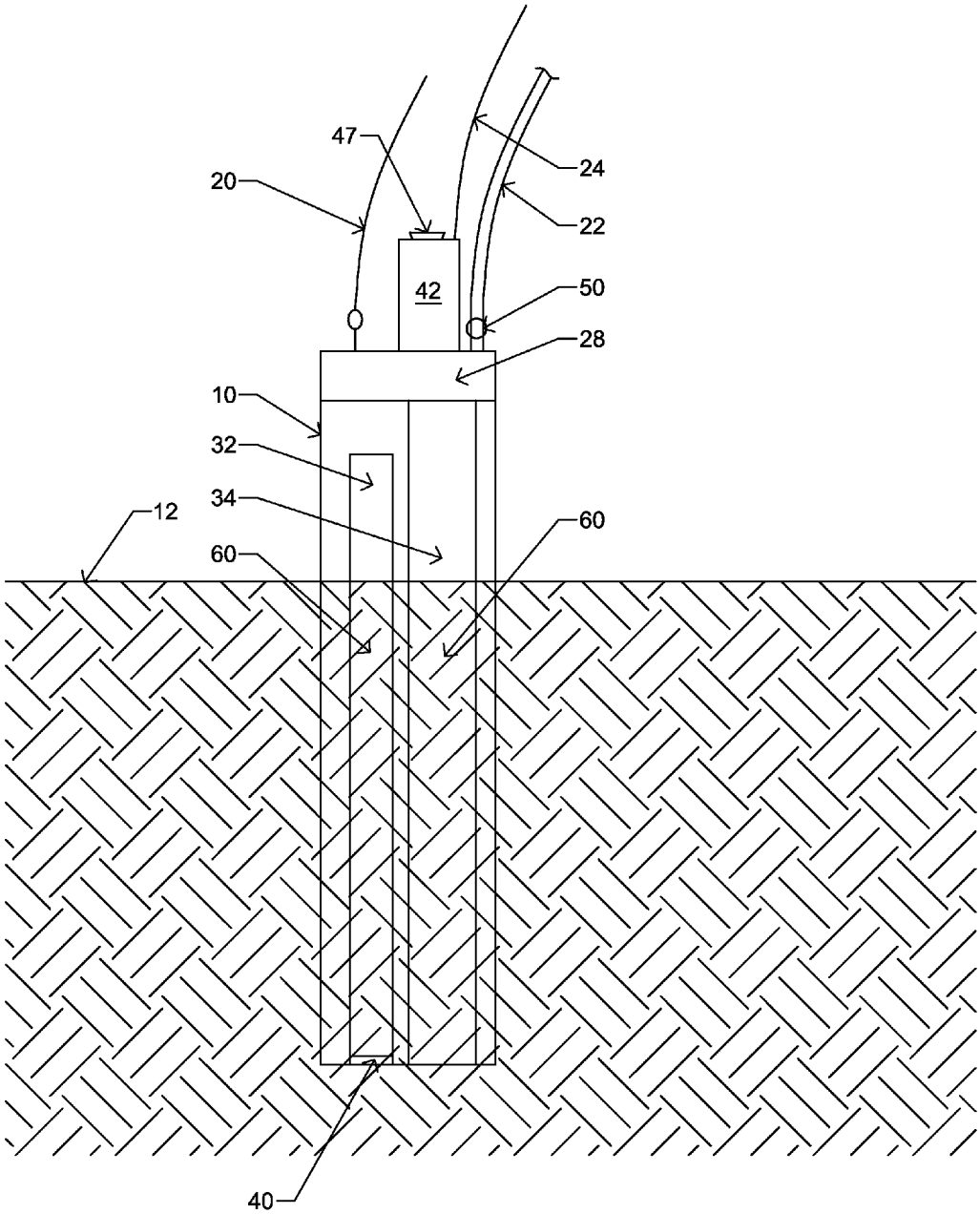
FIG. 5B is a side view of the suction corer device in FIG. 7A, now penetrating the sea bed.
Figure 5C:
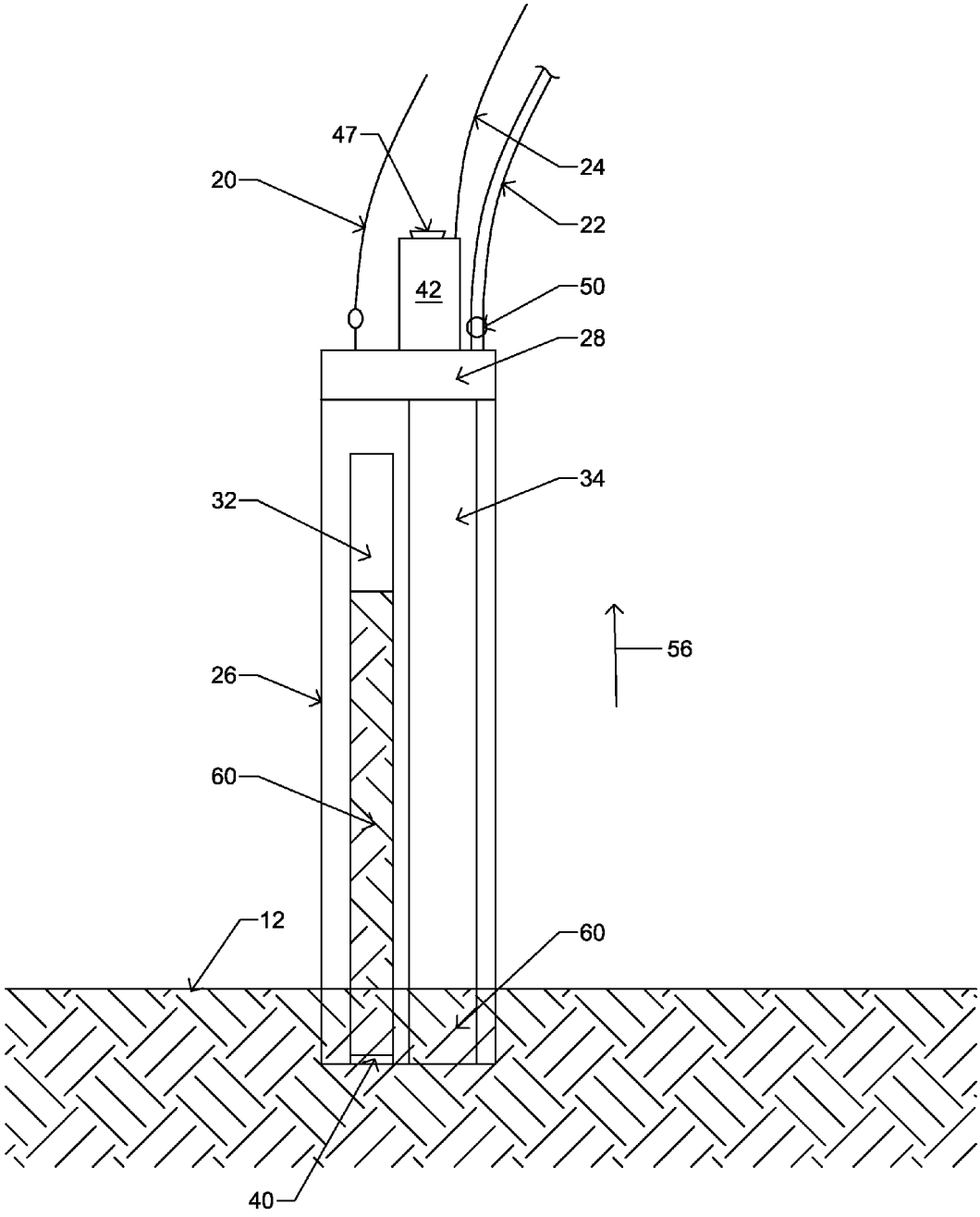
FIG. 5C is a side view of the suction corer device in FIGS. 7A and 7B, now being withdrawn from the sea bed.

FIGS. 5A, 5B and 5C illustrate use of the exemplary corer device 10 to obtain sample cores from the sea bed 12. For clarity, only a single core barrel 32 and a single pressure barrel 34 are depicted. FIG. 5A shows the corer device 10 having been placed with the distal end 52 of the corer device 10 onto the sea bed 12. The suction pump 42 is then actuated to evacuate the pressure barrel(s) 34. This creates a suction force within the pressure barrel 34 to cause the corer device 10 to be sucked downwardly into the sea bed 12 in the direction of the arrow 54. FIG. 5B depicts the corer device 10 now having been sunk to depth under the impetus of the suction force. It can be noted that both the core barrel(s) 32 and the pressure barrel(s) 34 are partially filled with sediment 60 from the sea bed 12. At this point, the suction pump 42 is turned off and the valve 46 is closed to block fluid flow through the outlet 44. The valve 50 is now opened so that air flows from the air supply line 22 and into the pressure barrels 34. As the pressure barrels 34 are pressurized, the corer device 10 is urged upwardly and out of the sea bed 12, as depicted by the movement arrow 56 in FIG. 5C. As can be seen, the pressure barrels 34 are evacuated of sea bed sediment 60 as the corer device 10 is removed from the sea bed. However, the core barrels 32 still retain a core of sediment 60 due to the presence of the core catchers 40 at their lower ends. As the corer device 10 becomes sufficiently free from the sea bed 12, the air pressure in the pressure cells is adjusted to make the corer device 10 positively buoyant and the corer rises to the water surface. It can be retrieved to the vessel 14 using the tether 20. The cored sediment 60 within the core barrels 32 can then be removed from the corer device 10 either whilst floating or on board the vessel 14. The core 60 of sediment within the core barrels 32 can then be removed from the corer device 10 on board the vessel 14.

Figure 6:
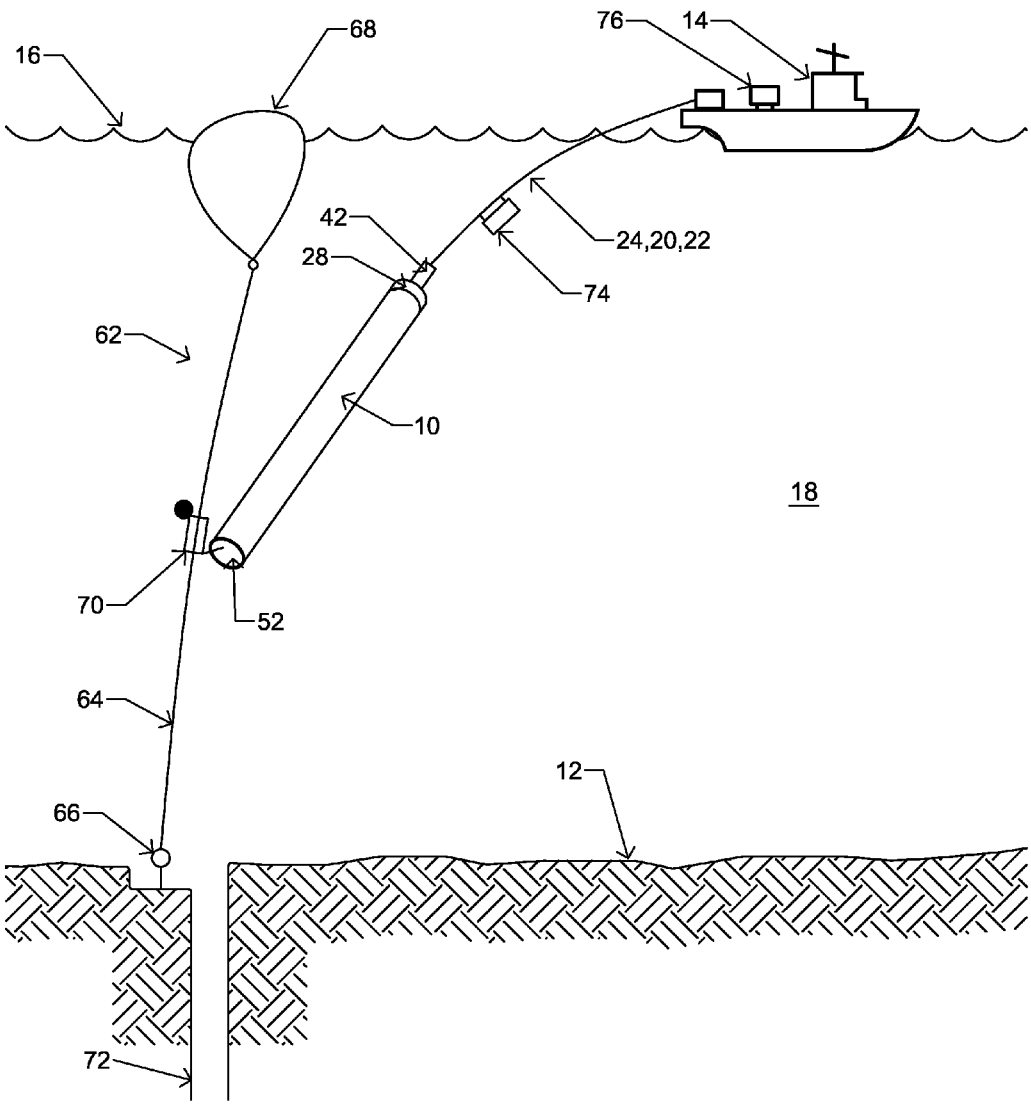
FIG. 6 illustrates deployment of the suction corer device using a corer locating system.

FIG. 6 depicts the use of the suction corer 10 in conjunction with a corer locator system, generally shown at 62. The exemplary corer locator system 62 is shown to include a guide line 64 that is anchored to the sea bed 12 by anchor 66. The upper end of the guide line 64 is affixed to a floating buoy 68. The buoys 68 and anchor 66 maintain the guide line 64 in a generally vertical orientation within the sea 18. A locator sleeve 70 in surrounds the guide line 64 and is moveable upwardly and downwardly thereupon. The locator sleeve 70 is securely affixed proximate the distal end 52 of the corer device 10. The anchor 66 is pre-positioned in a location wherein it is desired to obtain a core. In FIG. 6, a pre-formed coring hole 72 is shown proximate the anchor 66. It I desired to deploy the corer device 10 into the hole 72. It is presently preferred that the sleeve 70 be provided with a release mechanism (not shown) of a type known in the art, which permits the corer device 10 to be released from the sleeve 70 when the corer device 10 is proximate the anchor 66, thereby freeing the corer device 10 to enter the hole 72. The release mechanism may be a simple latch that is activated upon contact of the anchor 66 by the sleeve 70. Alternatively, the release mechanism may comprise a remotely activated releasing device. The corer locator system 62 is useful for repeatedly deploying the corer device 10 to the same general location upon the sea bed 12.

It is noted that the suction pump 42 can be used as a means of propulsion for movement of the corer device 10 through the sea 18. Operation of the suction pump 42 will draw sea water from the pressure cells 34 through the fluid outlet 44 and outwardly through the exhaust 47 in the manner of a propulsive jet, thereby propelling the corer device 10 forward through the sea 18. In the arrangement depicted in FIG. 6, the suction pump 42 may be actuated to propel the corer device 10 along the guide line 64 downwardly toward the anchor 66.

FIG. 6 also illustrates a camera 74 that is affixed to the tether 20. The camera 74 may be a wired or wireless camera which transmits video signal to a monitor 76 located on board the vessel 14. The video signal can assist an operator on board the vessel 14 in controlling the corer device 10 to guide it to its destination either by increasing/decreasing the flow through pump 42 or by manipulation of the tether 20 or guide line 64.

Figure 7:
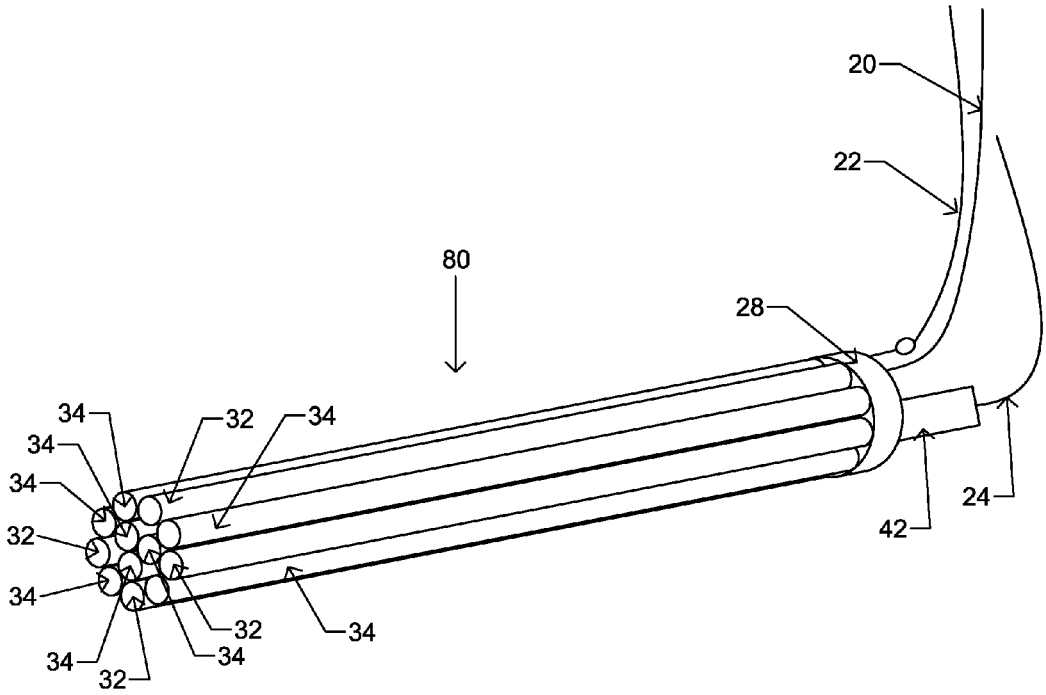
FIG. 7 is an isometric view of an alternative embodiment for a suction corer device in accordance with the present invention.
Figure 8:
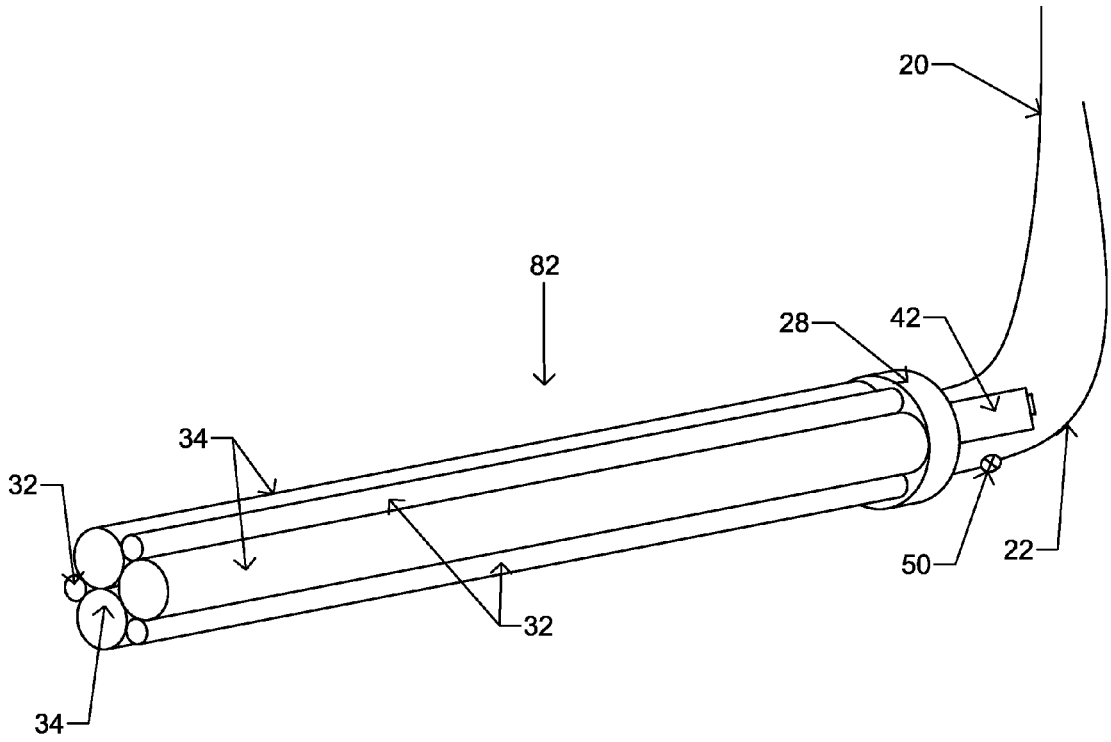
FIG. 8 is an isometric view of a further alternative embodiment for a suction corer device in accordance with the present invention.
Figure 9:
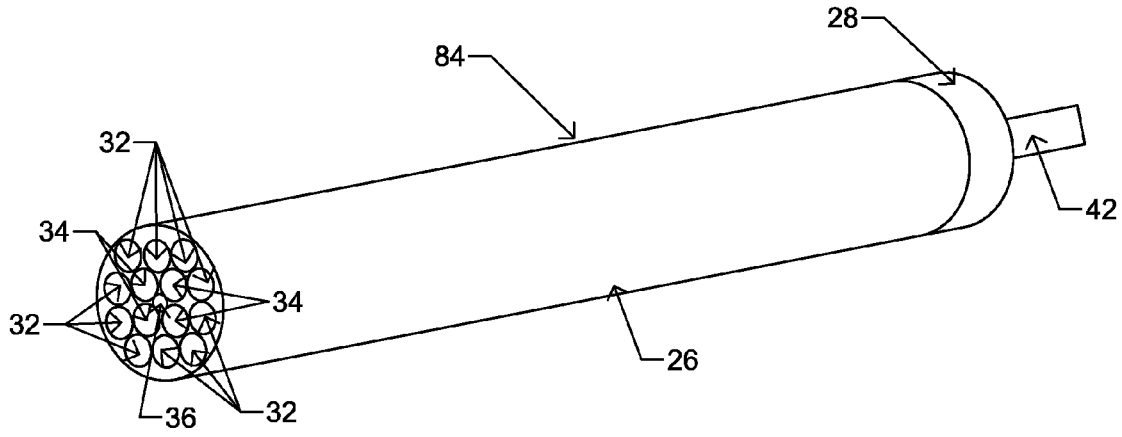
FIG. 9 is an isometric view of a further alternative embodiment of suction corer in accordance with the present invention.
Figure 10:
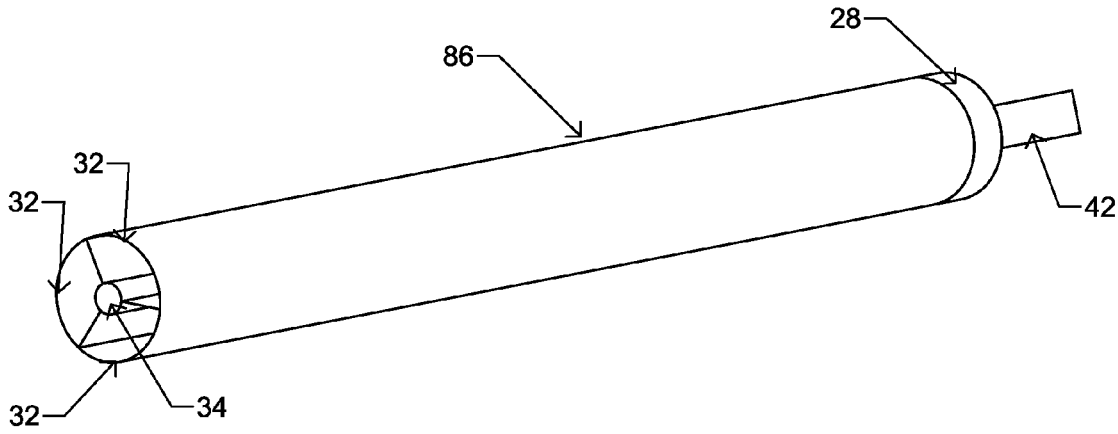
FIG. 10 is an isometric view of a further alternative embodiment of suction corer in accordance with the present invention.

FIGS. 7-10 depict alternative embodiments for exemplary corer devices constructed in accordance with the present invention. Throughout the several drawings, like components are numbered with like reference numerals. FIG. 7 depicts an exemplary alternative corer device 80 wherein there are four core barrels 32 and eight pressure barrels 34. FIG. 8 illustrates an exemplary alternative corer device 82. In both FIGS. 7 and 8, the outer casing 26 has been omitted. In addition, there is no central rod 36. FIG. 9 depicts an alternative exemplary corer device 84. In the device 84, there are ten core barrels 32 which radially surround four pressure barrels 34 and a structural support rod 36. FIG. 10 illustrates a further exemplary corer device 86 wherein the central pressure barrel 34 is surrounded by three angular core barrels 32.

In operation, the corer device 10 (or 80, 82, 84 or 86) is assembled on board the surface vessel 14 and interconnected with the tether 20, air line 22 and control line 24. Thereafter, the corer device 10 is deployed from the vessel 14 and propelled to the sea bed 12. Coring is accomplished as described above.

Figure 11:
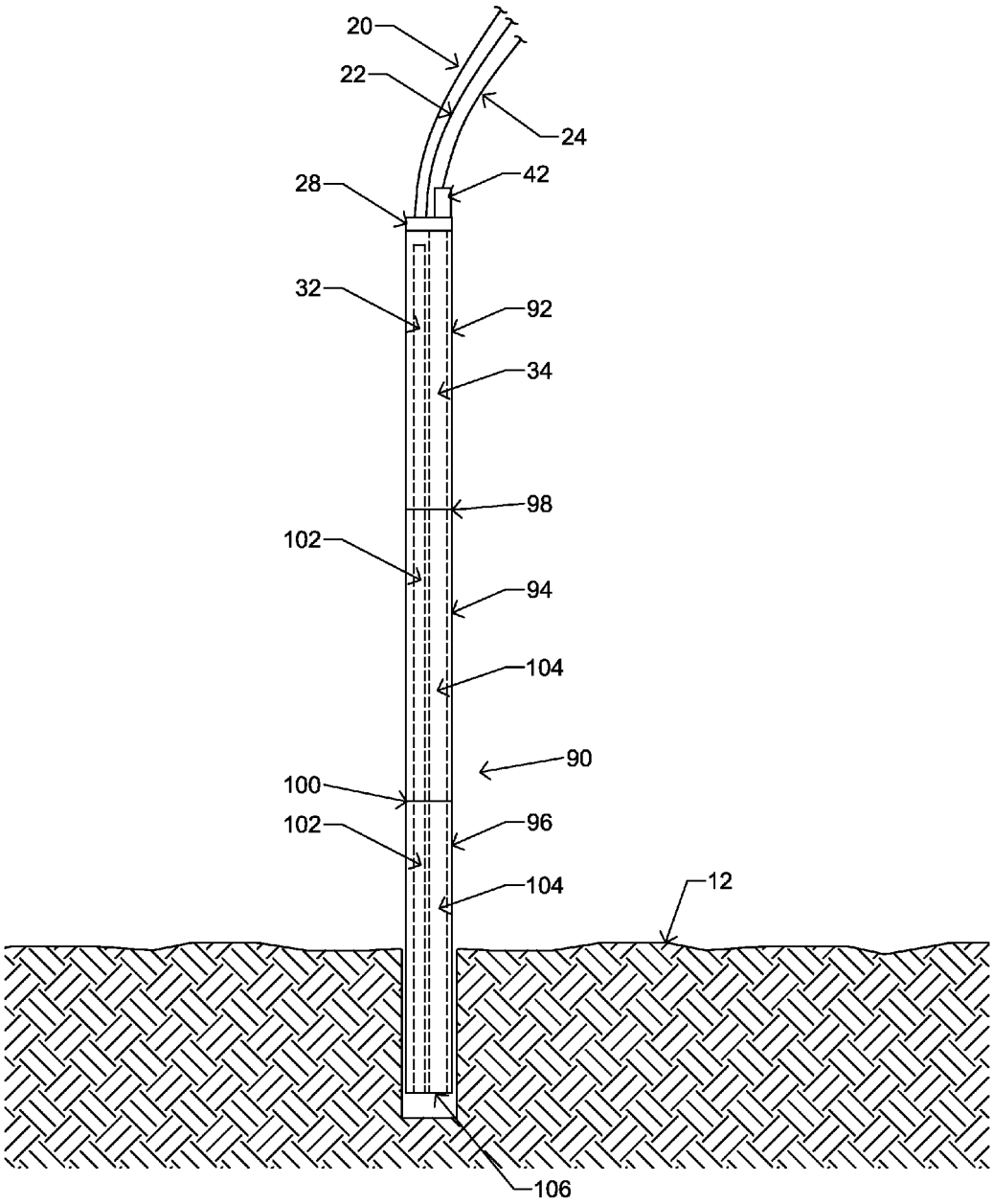
FIG. 11 is an external isometric view of an exemplary suction corer system which incorporates a coring device having multiple coring sections.

FIG. 11 depicts an exemplary modular coring device 90 which is formed of a plurality of coring device sections 92, 94, 96 that are concatenated in an end-to-end fashion. In the depicted embodiment, there are three coring device sections. However, there may be more or fewer than three, depending upon the depth of the sediment it is desired to core to. The sections 92 and 94 are attached at attachment point 98, while the sections 94 and 96 are affixed to each other at attachment point 100. The sections 92, 94, 96 may be attached by threading or, alternatively, by external joining collars or by other means known in the art. It is noted that the upper modular section 92 is virtually identical in to construction to the corer device 10 described earlier, in that the section 92 is provided with a pressure housing 28 and pump 42 which are interconnected with the pressure barrel 34. The other two sections 94, 96 are essentially extensions which feature barrel extensions 102 for the core barrel 32 and barrel extensions 104 for the pressure barrel 34. When the modular sections 94 and 96 are affixed to the section 92, the core barrel extensions 102 are aligned with and joined with the core barrel 32 and the pressure barrel extensions 104 are aligned with and joined with the pressure barrel 34.

In operation, the modular coring device 90 is assembled at the surface vessel 14 and then deployed into the water 18. The corer device 90 will proceed to the sea bed 12, as described previously, where the distal end 106 will be disposed into the sea bed 12. Thereafter, the corer device 90 is drawn into the sea bed 12 via the suction force within the extended pressure barrel provided by barrel 34 and extensions 104. The extended core barrel provided by barrel 32 and extensions 102 will fill with sediment from the sea bed 12. The corer device 90 is released from the sea bed 12 in the same manner as described previously with the application of fluid pressure within the pressure barrel(s) 34 to extract it.

Figure 12:
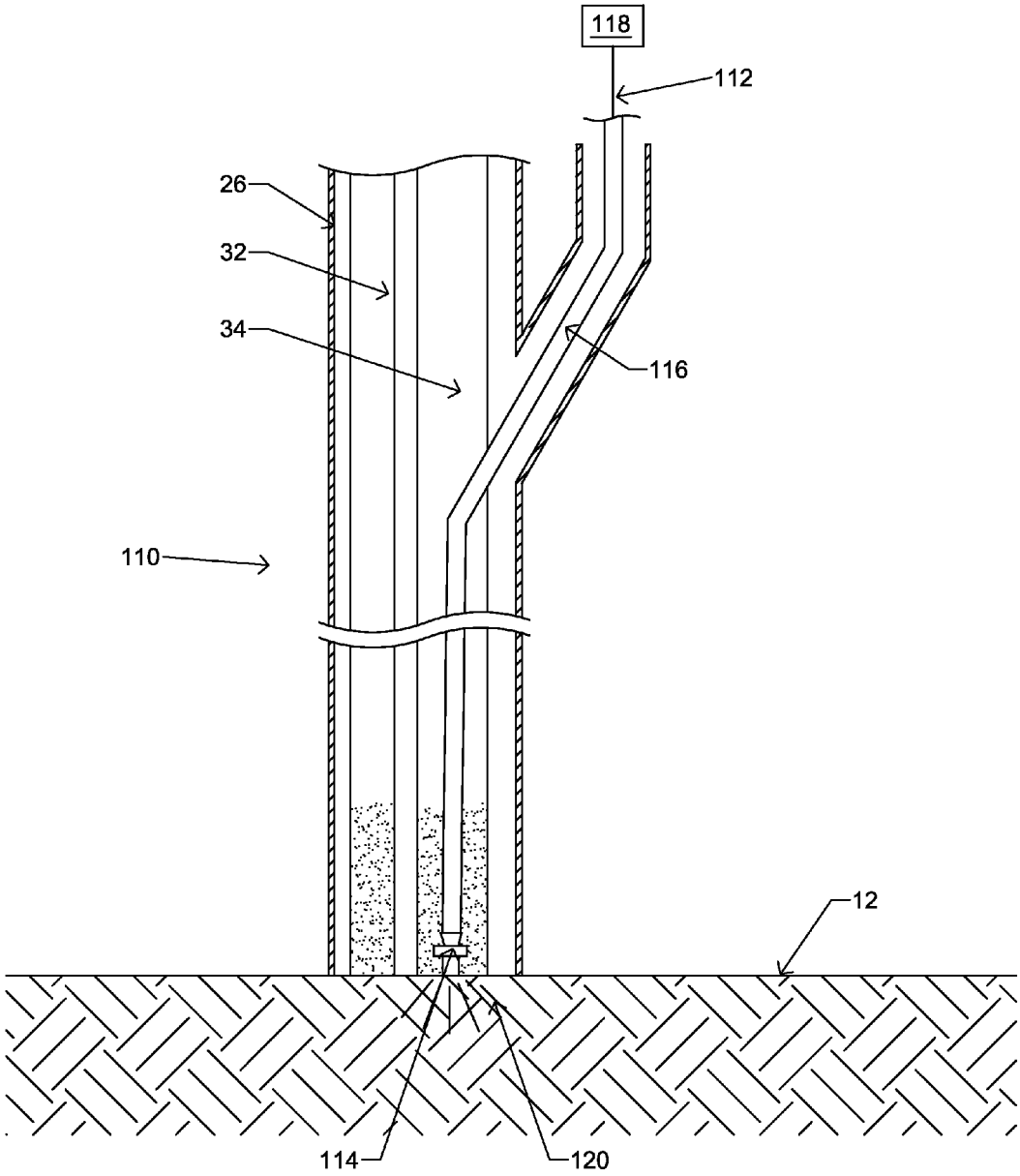
FIG. 12 is a side, cross-sectional view of an exemplary coring device which incorporates a water jet assembly.

FIG. 12 illustrates a further exemplary suction coring device 110 which incorporates a fluid jet system 112 to assist the coring device 110 in burrowing into the sea bed 12. The fluid jet system 112 includes a fluid jet nozzle 114 and fluid conduit 116 affixed thereto. It is noted that, while only a single nozzle 114 is depicted in FIG. 12, there may be more than one such nozzle 114. The fluid conduit 116 is operably associated with a pressurized fluid source 118. The fluid source 118 is preferably a high pressure fluid pump and is preferably located on board the surface vessel 14. When actuated, the fluid source 118 will flow high pressure fluid, such as water, through the conduit 116 and out of the nozzle 114 to create a high pressure spray 120. It is noted that the nozzle 114 is preferably affixed to the pressure barrel 34 of the corer device 110 and located inside of the housing 26. Operation of the fluid jet system 112 prior to or even during the coring operation can assist in allowing the corer device 110 to reach a desired coring depth by displacing sea bed sediment and allowing the corer device to burrow to greater depth.

Those of skill in the art will recognize that numerous modifications and changes may be made to the exemplary designs and embodiments described herein and that the invention is limited only by the claims that follow and any equivalents thereof.

What is claimed is:

1. A suction coring device comprising:

a hollow, generally cylindrical core barrel for retaining a core, the core barrel having an open distal end and a substantially closed proximal end;

a hollow, generally cylindrical pressure barrel having a distal end and a proximal end and disposed in a substantially parallel relation to the core barrel, the pressure barrel having a fluid inlet and a fluid outlet proximate the proximal end;

a fluid pump associated with the fluid outlet to cause a suction force within the pressure barrel by selective evacuation of the pressure barrel in order to urge the core barrel into a sea bed; and a fluid source operably associated with the fluid inlet to selectively flow pressurized fluid into the pressure barrel in order to remove the core barrel from the sea bed.

2. The suction coring device of claim 1 further comprising an outer casing radially surrounding the core barrel and the pressure barrel.

3. The suction coring device of claim 1 further comprising a core catcher disposed within the distal end of the core barrel for retaining a core within the core barrel.

4. The suction coring device of claim 1 wherein the core barrel and the pressure barrel are each formed of a plurality of modular sections that are interconnected in an end-to-end fashion.

5. The suction coring device of claim 1 wherein there is a plurality of core barrels and a plurality of pressure barrels.

6. The suction coring device of claim 1 further comprising a pressure housing secured to the distal end of the pressure barrel and providing fluid communication between the pressure barrel and the fluid pump.

7. The suction coring device of claim 1 wherein the pressure barrel provides an axial cross-sectional area that is greater than the axial cross-sectional area of the core barrel.

8. The suction coring system of claim 7 wherein the axial cross-sectional area of the pressure barrel is at least ten times that of the core barrel.

9. A suction coring system for obtaining cores from a sea bed, the system comprising:

a suction corer device that is deployable from a surface vessel, the suction corer device comprising:

one or more core barrels for retaining a core therein;

one or more pressure barrels;

a fluid pump operably associated with the one or more pressure barrel to create a suction force within the pressure barrel; and a fluid supply operably associated with the one or more pressure barrels to selectively flow pressurized fluid within the pressure barrel.

10. The suction coring system of claim 9 further comprising a corer locator system for guiding the suction corer device toward a location on the sea bed, the corer locator system comprising:

a guide line;

an anchor retaining a portion of the guide line within the sea bed proximate a desired location; and a buoy operably associated with the guide line to retain a portion of the guide line in a substantially vertical orientation above the anchor; and a guide sleeve affixed to the suction corer device and further moveably disposed upon the guide line for movement upwardly and downwardly thereupon.

11. The suction coring system of claim 9 further comprising a fluid jet system operably associated with the suction corer device to assist the corer device in coring within the sea bed by displacing sea bed sediment, the fluid jet system comprising:

a pressurized fluid source;

a nozzle; and a fluid conduit to transmit pressurized fluid from the fluid source to the nozzle.

12. The suction coring system of claim 9 wherein the one or more pressure barrels provide an axial cross-sectional area that is greater than the axial cross-sectional area of one or more core barrels.

13. The suction coring system of claim 12 wherein the axial cross-sectional area of the pressure barrels is at least ten times that of the core barrels.

14. The suction coring system of claim 9 wherein the fluid supply comprises an air compressor.

15. A method of obtaining a core from a sea bed comprising the steps of:

providing a suction coring device having:

a core barrel for retaining a core;

a pressure barrel;

disposing distal ends of the core barrel and pressure barrel into the sea bed;

creating a suction force within the pressure barrel to cause the core barrel to be drawn into the sea bed and be filled with sediment;

filling the pressure barrel with pressurized fluid to cause the suction coring device to be extracted from the sea bed and rise to the water surface due to positive buoyancy.

16. The method of claim 15 wherein the step of creating a suction force within the pressure barrel further comprises actuating a fluid pump in operable association with the pressure barrel to evacuate the pressure barrel.

17. The method of claim 15 wherein the step of filling the pressure barrel with pressurized fluid further comprises flowing fluid from a fluid source located upon the surface vessel through a fluid conduit and into the pressure barrel.

18. The method of claim 16 further comprising the steps of:

deploying the suction coring device into an area of sea from a surface vessel; and moving the suction coring device toward the sea bed by operating the suction pump to propel the coring device through the sea.

19. The method of claim 15 further comprising the steps of:

deploying the suction coring device into an area of sea from a surface vessel; and guiding the suction coring device toward a desired location along a guide line.

* * * * *